US005771546A

United States Patent [19]

Minato

[11] Patent Number: 5,771,546

[45] Date of Patent: Jun. 30, 1998

[54] PULL TAB FOR SLIDE FASTENER SLIDER

[75] Inventor: Hitomi Minato, Toyama-ken, Japan

[73] Assignee: YKK Corporation, Tokyo, Japan

[21] Appl. No.: 768,243

[22] Filed: Dec. 17, 1996

[30] Foreign Application Priority Data

Dec. 19, 1995 [JP] Japan ..... 7-330621

[51] Int. Cl.[6] ..... A44B 19/00

[52] U.S. Cl. ..... 24/429; 24/419; 24/431

[58] Field of Search ..... 24/429, 419, 437, 24/300, 301; 294/3.6

[56] References Cited

U.S. PATENT DOCUMENTS

| | | | |
|---|---|---|---|
| 3,899,804 | 8/1975 | Kawashima . | |
| 4,718,149 | 1/1988 | Tsubokawa | 24/392 |
| 4,790,050 | 12/1988 | Tshii | 24/419 |
| 4,949,434 | 8/1990 | Minami | 24/429 |
| 4,974,297 | 12/1990 | Akashi | 24/431 |
| 5,101,538 | 4/1992 | Dieter . | |
| 5,187,841 | 2/1993 | Takemura et al. | 24/429 |
| 5,347,692 | 9/1994 | Ebata | 24/419 |

FOREIGN PATENT DOCUMENTS

| | | |
|---|---|---|
| 0 291 816 | 11/1988 | European Pat. Off. . |
| 0 369 258 | 5/1990 | European Pat. Off. . |
| 0 369 438 | 5/1990 | European Pat. Off. . |
| 0 603 759 | 6/1994 | European Pat. Off. . |
| 2 190 706 | 11/1987 | United Kingdom . |

*Primary Examiner*—Victor N. Sakran
*Attorney, Agent, or Firm*—Hill & Simpson

[57] ABSTRACT

A pull tab of a slide fastener slider includes a pull tab body formed of extruded thermoplastic synthetic resin having an internal hollow portion extending longitudinally or transversely therethrough, and an uneven outside surface which provides an ornamental function, said pull tab body having flexibility and elasticity an ornamental function by virtue of said hollow portion and the uneven outside surface. The pull tab body may be transparent or semitransparent in which instance an ornamental material is preferably embedded in the pull tab body to improve the aesthetical appearance of the pull tab. The pull tab body may further has a connecting portion at its one end for connection to a slider body, and a grip piece at the opposite end. The thermoplastic synthetic resin may be extrusion-molded to be a continuous blank. The blank is then cut into pull tab bodies of individual product widths. The pull tab with a flexibility and an ornamental function can be mass-produced by extrusion molding at a low cost.

20 Claims, 7 Drawing Sheets

PULL TAB FOR SLIDE FASTENER SLIDER

BACKGROUND OF THE INVENTION

1. Field of the Invention

The present invention relates generally to a pull tab of a slider for a slide fastener, and more particularly to a pull tab for a slide fastener slider having a pull tab body which is extrusion-molded of thermoplastic synthetic resin, which can give an adequate degree of flexibility or elasticity to the pull tab, and is easy to grip and manipulate.

2. Description of the Prior Art

Japanese Utility Model Laid-open Publication No. SHO 62-85114 discloses, as illustrated in FIG. 14 of the accompanying drawings, a pull tab 30 of a slider for slide fastener, which comprises a transparent hollow pull tab body 31 of synthetic resin having a connecting ring 32 at one end for connection to a slider body 33, and an opening 34 at the other end. The hollow pull tab body 31 receives therein an identification tag 35, such as an ornamental plate or the like, and the opening 34 of the pull tab body 31 is closed by an end plug 36.

Further, Japanese Utility Model Laid-open Publication No. SHO 62-102407 discloses, as illustrated in FIG. 15, another known pull tab 40 of a slide fastener slider, which includes a pull tab body 41 molded of highly elastic soft synthetic rubber or soft synthetic resin and having a plurality of transverse ribs 42 on a part of a front surface of the pull tab body 41. A connecting member 43 of metal or rigid synthetic resin is embedded in an end of the pull tab body 41 for connecting the pull tab 40 to a slider body 44.

The first-mentioned slider pull tab is rigid as a whole and has neither flexibility nor elasticity. Furthermore, since the pull tab has a complex construction and is molded by an injection molding means or a compression molding means, the production of such pull tab requires much labor and an increased cost.

The second-mentioned slider pull tab is molded of a soft synthetic rubber or resin by an injection molding means or a compression molding means, and so the molded pull tab requires a high production cost and cannot be used for a slide fastener in which the pull tab is subjected to a large pulling force. Furthermore, since the ribs are provided on only a part of the pull tab body, not the entire surface thereof, they cannot perform a sufficient ornamental function.

SUMMARY OF THE INVENTION

With the foregoing problems of the prior art in view, it is a primary object of the present invention to provide a pull tab for a slider fastener slider which is made of a thermoplastic synthetic resin but has no problem in terms of strength, has an aesthetical appearance so that it can be used as an accessory or ornament of a garment, which has an adequate degree of flexibility or elasticity and is easy to manipulate, and which has a structure suitable for mass-production by extrusion molding means and hence can be manufactured with a considerable reduction of production cost, thus realizing an inexpensive product.

Another object of the present invention is to provide a slider pull tab for a slide fastener having a structure capable of easily providing a pull tab body with a sufficient ornamental function.

A further object of the present invention is to provide a slider pull tab for a slide fastener which has a particular corrugated design pattern which is simply formed, partly for ornamental purposes, on the outside surface of an elongated pull tab body formed by extrusion molding.

Still another object of the present invention is to provide a slider pull tab for a slide fastener which is easy to grip and hence can be manipulated with utmost ease.

Yet another object of the present invention is to provide a slider pull tab for a slide fastener which includes a pull tab body having a connecting portion so constructed as to secure easy attachment of the pull tab body to a slider body, thus easily assembling a slide fastener slider.

To achieve the foregoing object, there is provided, according to the present invention, a pull tab of a slide fastener slider, which comprises: a pull tab body molded of extruded thermoplastic synthetic resin having an internal hollow portion extending longitudinally or transversely therethrough, the pull tab body having a desired degree of flexibility by virtue of the hollow portion.

The pull tab body is preferably extrusion-molded.

Further, the pull tab body may have an uneven outside surface, or alternatively, the pull tab body may have a smooth arc-like surface curving outwardly.

The term "uneven surface" is used herein to refer to an undulated surface, a corrugated surface, a ribbed surface, a ridged surface, toothed surface, or any other rugged surface. The number of undulations of the uneven surface may be one or more.

It is also preferable that the pull tab body is transparent or semi-transparent and includes an ornamental material embedded therein.

In one preferred form of the invention, the hollow portion extends longitudinally through in the pull tab body, and the uneven outside surface includes at least one ridge extending helically about a longitudinal axis of the hollow portion along the length of the pull tab body.

The pull tab body preferably has a grip piece formed integrally with an end of the pull tab body.

It is also preferable that the pull tab body has a connecting portion formed integrally with an end of the pull tab body for connecting the pull tab body to a slider body. The shape and configuration of the connecting portion is determined by a form of connection between two or more objects to be connected, but in general, the connecting portion has an enlarged cylindrical shape or a plate-like configuration.

In one preferred form of the invention, the connecting portion of the pull tab body forms a planar connecting ring adapted to be connected to the slider body.

In another preferred form of the invention, the pull tab further includes a connecting member having a connecting ring adapted to be connected to the slider body. The connecting member is connected to the connecting portion of the pull tab body at an end remote from the connecting ring.

In still another preferred form of the invention, an end of the pull tab body is connected to a connecting member, which has a connecting ring adapted to be connected to a slider body.

The above and other objects, features and advantages of the present invention will become manifest to those versed in the art upon making reference to the detailed description and accompanying sheets of drawings in which preferred structural embodiments incorporating the principles of the present invention are shown by way of illustrative example.

DETAILED DESCRIPTION OF THE PREFERRED EMBODIMENTS

Preferred embodiments of the present invention will be described below in greater detail with reference to the accompanying drawings.

Figure 13:
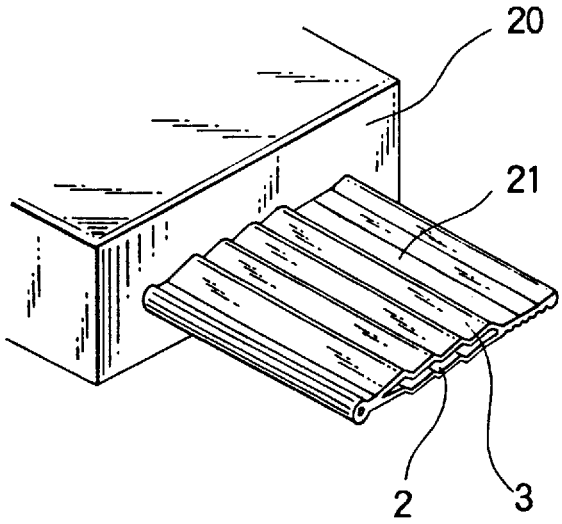
FIG. 13 is a schematic perspective view showing the manner in which the pull tab body of this invention is molded on an extrusion molding machine.
Figure 14:
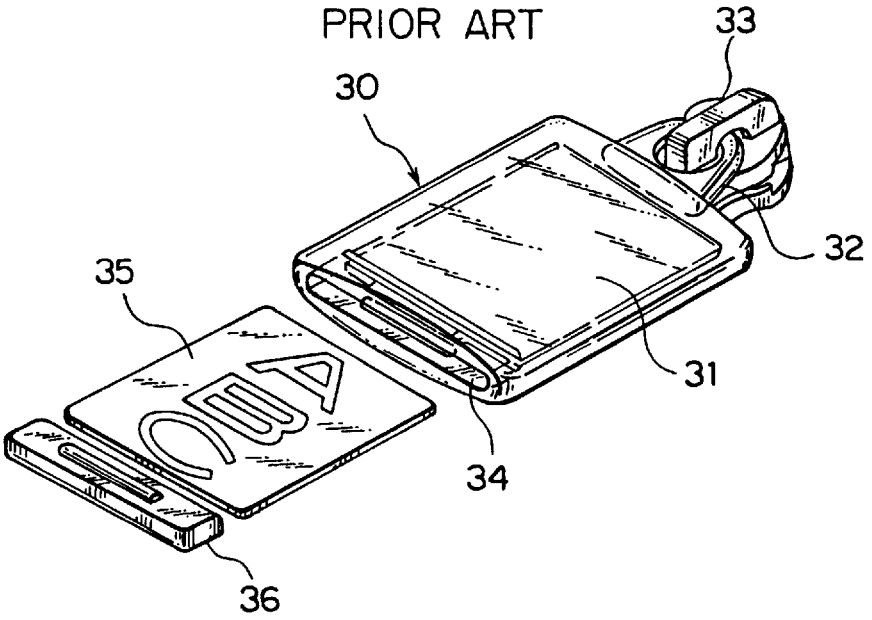
FIG. 14 PRIOR ART
FIG. 14 is an exploded perspective view of a pull tab body of a conventional slider pull tab.
Figure 15:
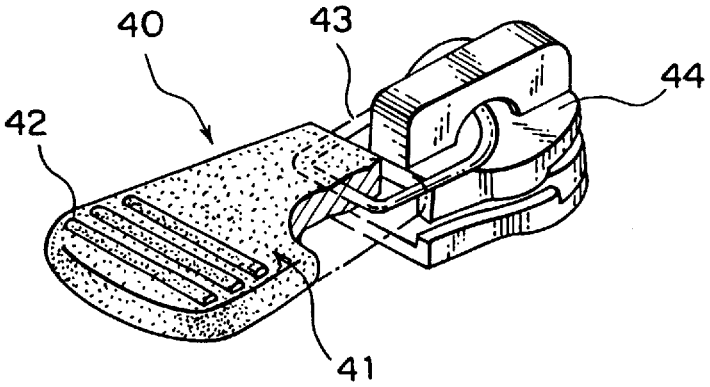
FIG. 15 PRIOR ART
FIG. 15 is a perspective view, partly broken away for clarity, of a pull tab body of another conventional slider pull tab.

The slider pull tab for a slide fastener according to the present invention each includes a pull tab body molded by an extrusion molding means or machine such as shown in FIG. 13, using a thermoplastic synthetic resin such as polyamide, polyacetal, polypropylene or polyethylene terephthalate. An extrusion-molded, continuous blank is then cut into pull tab bodies having individual product lengths or widths. According to this invention, alternatively of extrusion-molding, the pull tab body may be injection-molded.

Figure 1:
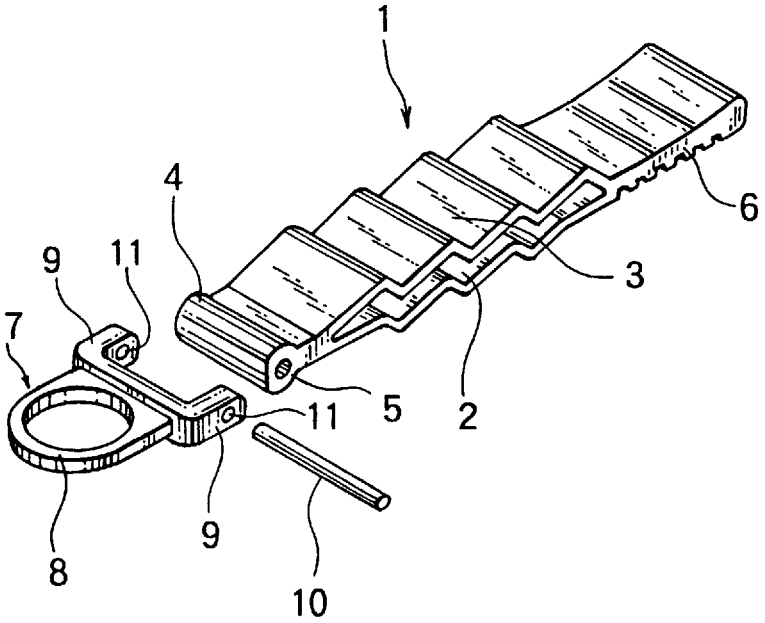
FIG. 1 is an exploded perspective view of a pull tab according to the first embodiment of the present invention.

FIG. 1 shows a pull tab for a slide fastener slider according to a first embodiment of the present invention. The pull tab includes a pull tab body 1 having an internal hollow portion 2 extending transversely therethrough. The pull tab body 1 have front and back uneven surfaces 3, each being in the form of a corrugated surface. By virtue of the hollow portion 2, the pull tab body 1 has an adequate flexibility or elasticity. The pull tab body 1 has one end (base end) in the form of an enlarged cylindrical connecting portion 4 extending transversely of the pull tab body 1 for connecting the pull tab body 1 to a connecting member 7. The connecting portion 4 has a through-hole 5 for receiving therein a connecting pin 10. The pull tab body 1 further has a relatively thin plate-like grip piece 6 formed integrally with the pull tab body 1 at the opposite end (free end). The grip piece 6 has a slightly upwardly curved smooth surface at its front side, and a rugged surface at its back side, the rugged surface being composed of parallel ridges much smaller than those of the corrugated surfaces (uneven surfaces) 3, so that the grip piece 6 can be gripped easily and reliably.

Figure 2:
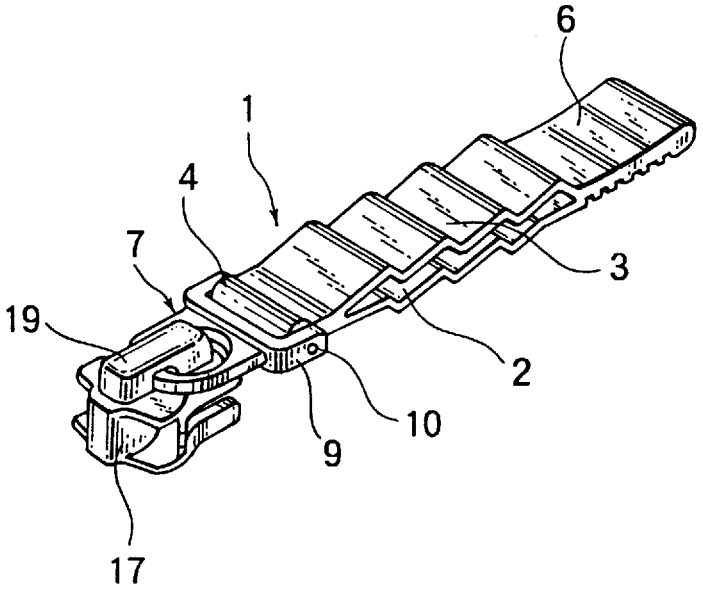
FIG. 2 is a perspective view of a slider in which the pull tab of FIG. 1 is used.

The connecting member 7 is molded by die casting using a diecast metal or formed from a thermoplastic synthetic resin and has, at its one end, a connecting ring 8 adapted to be connected to a slider body 17 as shown in FIG. 2. At the opposite end, the connecting member 7 has a pair of parallel spaced support legs 9, 9 for pivotally supporting therebetween the connecting portion 4 of the pull tab body 1. The support legs 9, 9 have a pair of transversely aligned bearing holes 11 for receiving therein the connecting pin 10.

Figure 3:
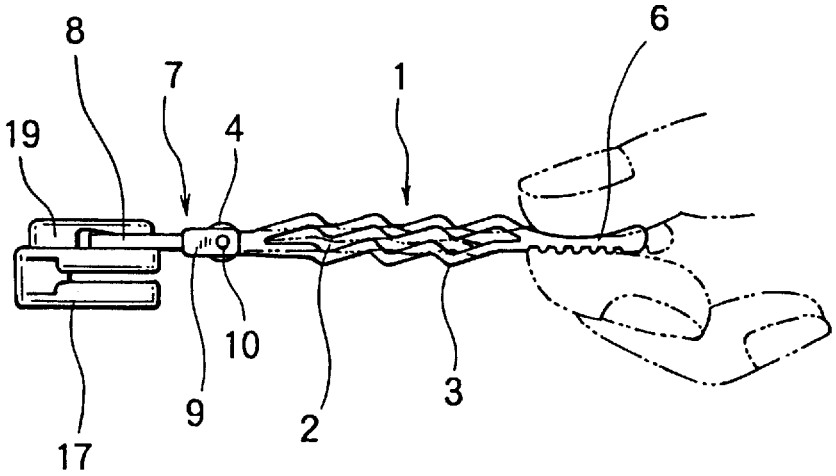
FIG. 3 is a side view showing the manner in which the slider of FIG. 1 is in use.

For assembling the pull tab, the connecting portion 4 of the pull tab body 1 is received between the support legs 9, 9, and then the connecting pin 10 is inserted into the bearing holes 11 in the respective support legs 9 through the through-hole 5 in the connecting portion 4. Thus, the pull tab body 1 is pivotally connected to the connecting member 7. Thereafter, the connecting ring 8 of the connecting member 7 is pivotally connected to a pull-tab attaching portion 19 of the slider body 17, as shown in FIG. 2, thus completing the slider. In use, the slider is manipulated by pulling the pull tab body 1 attached to the slider body 17 by gripping the grip piece 6, as shown in FIG. 3.

Figure 4:
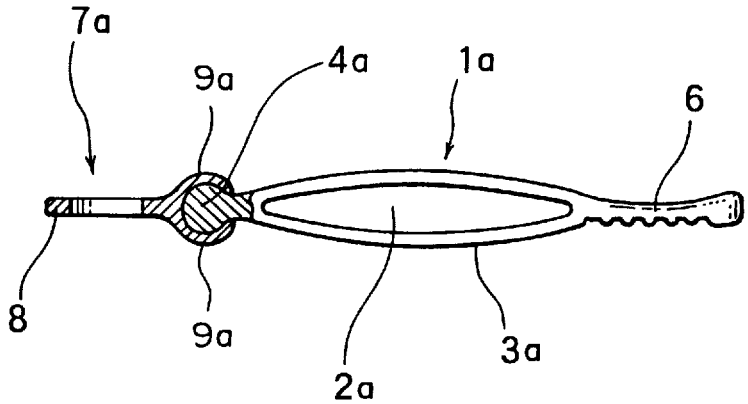
FIG. 4 is a side view, partly in cross-section, showing a first modified form of a pull tab body of the pull tab according to the second embodiment of the present invention.

FIG. 4 shows a pull tab body 1*a* according to a second embodiment of the present invention. The pull tab body 1*a* is formed by extrusion molding of a so-called "horizontal" type (described later) and has a connecting portion 4*a* and a grip piece 6 at its opposite ends. The pull tab body 1*a* has a large internal hollow portion 2*a* extending transversely therethrough, the hollow portion 2*a* having a substantially oblong cross section. The pull tab body 1 has front and back uneven surfaces 3*a,* each being in the form of an outwardly projecting curved or arcuate surface. Thus, the pull tab body 1*a* is swelled outwardly at a central portion thereof. By virtue of the large oblong hollow portion 2*a,* the pull tab body 1*a* has an adequate degree of flexibility or elasticity. The grip piece 6 formed at the free end of the pull tab body 1*a* is identical in configuration as that of the first embodiment previously described. The connecting portion 4*a* formed at the base end of the pull tab body 1 is in the form of an enlarged circular solid cylinder. The solid cylindrical connecting portion 4*a* is firmly gripped or clenched by a generally U-shaped grip arms 9*a,* 9*a* of a connecting member 7*a,* thus completing a pull tab. The connecting member 7*a* has a connecting ring 8 at an end remote from the grip arms 9*a,* 9*a.*

Figure 5:
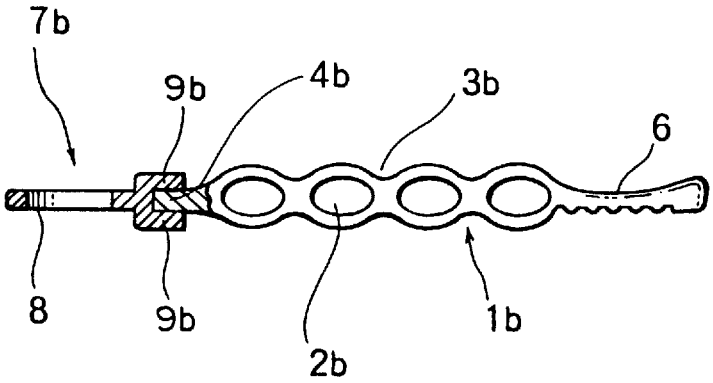
FIG. 5 is a side view, partly in cross-section, showing a second modified form of the pull tab body according to the third embodiment of the present invention.

FIG. 5 illustrates a pull tab body 1*b* according to a third embodiment of the present invention. The pull tab body 1*b* is formed by extrusion molding of the horizontal type and includes a connecting portion 4*b* and a grip piece 6 at its opposite ends. The pull tab body 1*b* has a plurality of internal hollow portions 2*b* extending transversely therethrough. The hollow portions 2*b* are arranged at regular intervals along the length of the pull tab body 1*b,* each of which has an oblong shape in cross section so that the pull tab body 1*b* have front and back uneven surfaces 3*b,* each being in the form of undulated surface 3*b.* Owing to the hollow portions 2*b,* the pull tab body 1*b* has an adequate degree of flexibility or elasticity. The grip piece 6 formed integrally with a free end of the pull tab body 1*b* is identical in configuration as that of the foregoing embodiments. The connecting portion 4*b* formed at a base end of the pull tab body 1*b* has a flat plate-like configuration and is firmly gripped or clenched by a pair of front and back grip arms 9*b*, 9*b* of a connecting member 7*b*, thus completing a pull tab. The connecting member 7*b* has a connecting ring 8 at an end remote from the grip arms 9*b*, 9*b*.

Figure 6:
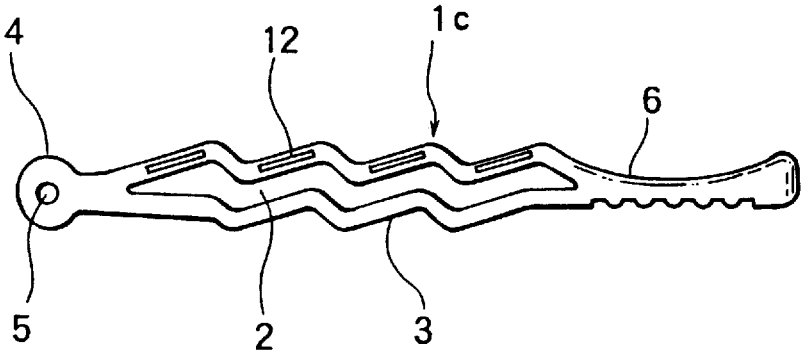
FIG. 6 is a side view showing a third modified form of the pull tab body according to the fourth embodiment of the present invention.

FIG. 6 shows a pull tab body 1*c* according to a fourth embodiment of the present invention. The pull tab body 1*c* is formed by extrusion molding of the horizontal type and has a connecting portion 4 and a grip piece 6 at its opposite ends. The pull tab body 1*c* have front and back corrugated surfaces (uneven surfaces) 3. The pull tab body 1*c* further has an internal hollow portion 2 extending transversely therethrough. The hollow portion 2 has a wave-like shape in transverse cross section. Due to the presence of the hollow portion 2, the pull tab body 1*c* has an adequate degree of flexibility or elasticity. The grip piece 6 is formed integrally with a free end of the pull tab body 1*c*. The connecting portion 4 formed at a base end of the pull tab body 1*c* has an enlarged circular cylindrical shape having a central through-hole 5 for enabling the pull tab body 1*c* to be attached to the connecting member 7 shown in FIG. 1. A front part of the pull tab body 1*c* defining an upper periphery of the hollow portion 2 has a plurality of ornamental materials 12 embedded therein to provide an attractive appearance to the pull tab body 1*c*. For ornamental purposes, the pull tab body 1*c* is preferably transparent or semitransparent so that the ornamental materials 12 can be observed from the outside of the pull tab body 1*c*. The ornamental materials 12 eligible for this purpose may be a piece of fabric, paper, tape or reflective tape having various colors and/or a design pattern.

Figure 7:
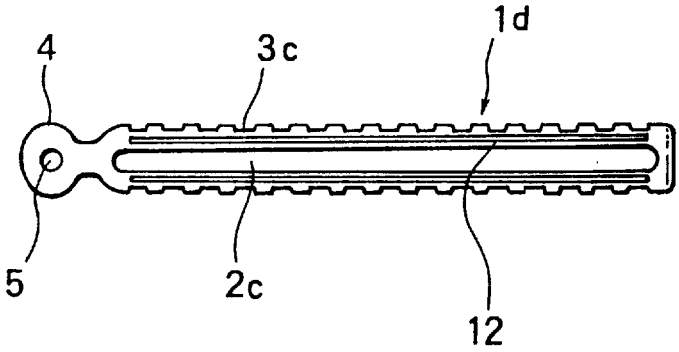
FIG. 7 is a side view showing a fourth modified form of the pull tab body according to the fifth embodiment of the present invention.

FIG. 7 illustrates a pull tab body 1*d* according to a fifth embodiment of the present invention. The pull tab body 1*d* is formed by extrusion molding of the horizontal type and has a connecting portion 4 at its one end. The pull tab body 1*d* is an elongated rectangular plate-like member having, front and back ribbed surfaces (uneven surfaces) 3*c* having a multiplicity of parallel ribs extending across the width of the pull tab body 1*d*. The pull tab body 1*d* further has an internal hollow portion 2*c* in the form of a slot having an elongated rectangular cross section. The hollow portion 2*c* thus provided gives an adequate degree of flexibility or elasticity to the pull tab body 1*d*. Each of front and back parts of the pull tab body 1*d* includes an ornamental material 12 embedded therein, and hence the pull tab body 1*d* is preferably transparent or semitransparent. The connecting portion 4 formed at a base end of the pull tab body 1*d* comprises an enlarged circular cylinder having a central through-hole 5 for connection to the connecting member 7 shown in FIG. 1. Although the pull tab body 1*d* has no means or part corresponding to the grip piece 6 shown in the respective foregoing embodiments, it is possible to provide a similar grip piece formed integrally with the other end of the pull tab body 1*d*.

Figure 8:
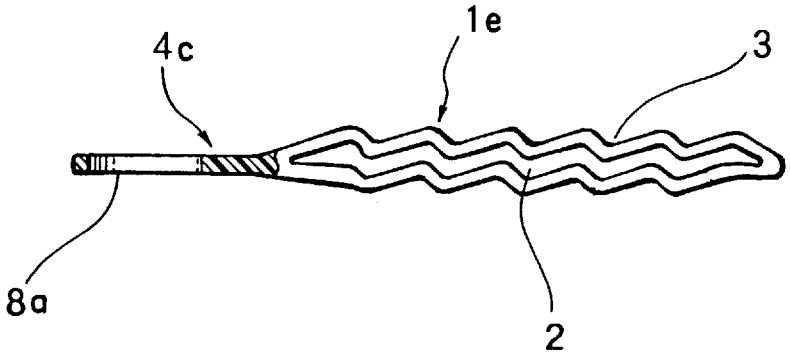
FIG. 8 is a side view, partly in cross-section, showing a fifth modified form of the pull tab body according to the sixth embodiment of the present invention.

FIG. 8 shows a pull tab body 1*e* according to a sixth embodiment of the present invention. The pull tab body 1*e* is formed by extrusion molding of the horizontal type and has a connecting portion 4*c* at its one end. The pull tab body 1*e* has front and back corrugated surfaces (uneven surfaces) 3. The pull tab body 1*e* further has an internal hollow portion 2 of a generally wave-like cross section extending transversely through the pull tab body 1*e*. By virtue of the hollow portion 2, the pull tab body 1*e* has an adequate degree of flexibility or elasticity. The connecting portion 4 formed at a base end (fixed end) of the pull tab body 1*e* has a thin plate-like shape and is formed with a circular hole so as to provide a connecting ring 8*a* formed integrally with the connecting portion 4. The pull tab body 1*e* having such connecting portion 4*c* can be directly attached to a slider body 17, as shown in FIG. 2. The pull tab body 1*e* may include an integral grip piece at a free end remote from the connecting portion 4*c*.

Figure 9:
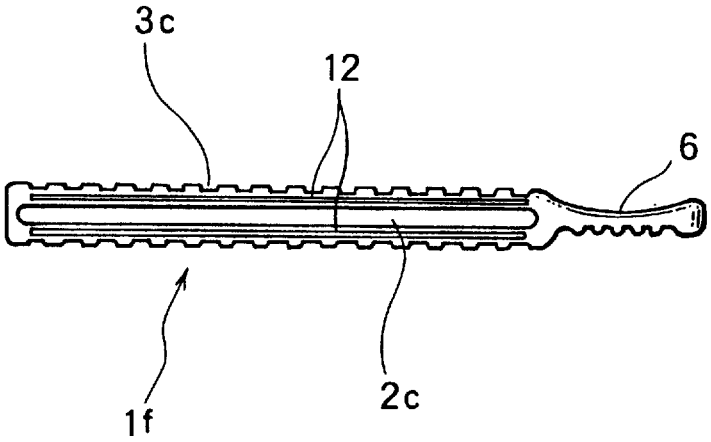
FIG. 9 is a side view showing a sixth modified form of the pull tab body according to the seventh embodiment of the present invention.

FIG. 9 illustrates a pull tab body 1*f* according to a seventh embodiment of the present invention. The pull tab body 1*f* is formed by extrusion molding of the horizontal type and has a grip piece 6 at its one end. The pull tab body 1*f* is an elongated rectangular plate-like member having front and back ribbed surfaces (uneven surfaces) 3*c* having a multiplicity of parallel grooves and ribs extending transversely across the width of the pull tab body 1*f*. The pull tab body 1*f* further has an internal hollow portion 2*c* in the form of a slot having an elongated rectangular cross section. Due to the presence of the hollow portion 2*c*, the pull tab body 1*f* has an adequate degree of flexibility or elasticity. Each of front and back parts of the pull tab body 1*f* has an ornamental material 12 embedded therein, and for ornamental purposes, the pull tab body 1*f* is preferably transparent or semitransparent. The grip piece 6 is formed integrally with one end (free end) of the pull tab body 1*f*.

The pull tab body 1*f* of the foregoing construction may be connected to the connecting member 7*b* having at one end a connecting ring 8 shown in FIG. 5, in order to complete a pull tab. In this instance, the other end of the pull tab body 1*f*, which is located remotely from the grip piece 6, is firmly gripped or clenched by and between a pair of front and back grip arms 9*b*, 9*b*. The grip arms may have an inwardly projecting locking claws at their distal ends, so that when the end of the pull tab body 1*f* is gripped by and between the grip arms 9*b*, 9*b*, a firm connection between the pull tab body 1*f* and the connecting member 7*b* can be obtained. As an alternative, a connecting member having a pintle (neither shown) at its one end may be used in which instance the pintle is received in the hollow portion 2*c*.

Figure 10:
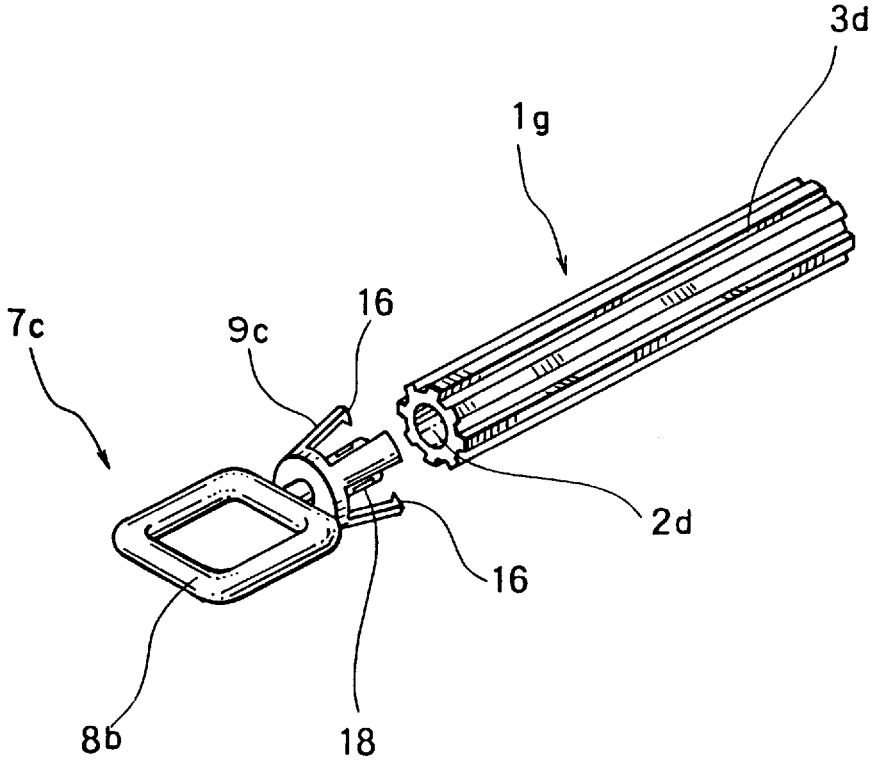
FIG. 10 is an exploded perspective view of a seventh modified form of the pull tab body according to the eighth embodiment of the present invention.

FIG. 10 shows a pull tab including a pull tab body 1*g* according to an eighth embodiment of the present invention. The pull tab body 1*g* is formed by extrusion molding of the so-called vertical type (described later) and have neither a connecting portion nor a grip piece. In the vertical type extrusion molding, a molten thermoplastic synthetic resin is extruded to be a molded continuous blank having the same transverse cross section as the desired pull tab body, and the continuous blank is cut into pull tab bodies 1*g* of individual product lengths. The pull tab body 1*g* comprises an elongated bar having on its outside surface a plurality of parallel grooves and ribs extending longitudinally therethrough so as to form a ribbed or toothed surface (uneven surface) 3*d*. The pull tab body 1*g* further has an internal hollow portion 2*d* in the form of a circular hole extending longitudinally through the pull tab body 1*g*. With the hollow portion 2*d* thus provided, the pull tab body 1*g* has an adequate flexibility or elasticity.

The pull tab body 1*g* has no means or part corresponding to the grip piece or the connecting portion described above. For connecting to a slider body 17 as shown in FIG. 2, the pull tab body 1*g* is firmly gripped at its one end by a plurality of circumferentially spaced grip arms 9*c*, 9*c* radially extending from an end of a connecting member 7*c*. The connecting member 7*c* further has a connecting ring 8*b* at an end remote from the grip arms 9*c*. Each of the grip arms 9*c*, 9*c* has a locking claw 16 projecting inwardly from the distal end of the grip arm 9*c*, so the grip arms 9*c*, 9*c* can firmly and reliably grip one end of the pull tab body 1*g*. The connecting member 7*c* further has a round core 18 disposed at the center of the grip arms 9*c* and receivable in the hollow portion (circular hole) 2*d* of the pull tab body 1*g* for retaining thereon the fixed end of the pull tab body 1*g*. The round core 18 may be omitted. It is also possible according to the present invention to form a connecting portion and a grip piece by thermally processing the opposite ends of the pull tab body 1*g*.

Figure 11:
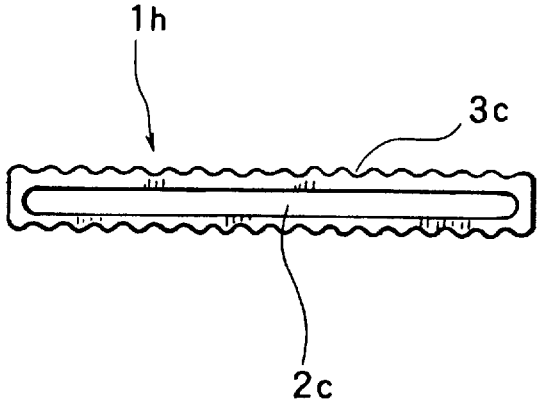
FIG. 11 is a side view showing an eighth modified form of the pull tab body according to the ninth embodiment of the present invention.

FIG. 11 illustrates a pull tab body 1*h* according to a ninth embodiment of the present invention. The pull tab body 1*h* is formed by extrusion molding of the horizontal type and has no means or part corresponding to the connecting portion or the grip piece described above. The pull tab body 1*h* comprises an elongated rectangular plate-like member having front and back ribbed surfaces (uneven surfaces) 3*c* having a multiplicity of parallel grooves and ribs extending throughout the width of the pull tab body 1*h*. The pull tab body 1*h* further has an internal hollow portion 2*c* in the form of a slot having an elongated rectangular cross section. By virtue of the hollow portion 2*c*, the pull tab body 1*h* has an adequate degree of flexibility or elasticity. Since the pull tab body 1*h* is devoid of a connecting portion and a grip piece, a connecting member having a pair of front and back grip arms may be used to grip one end of the pull tab body 1*h* for subsequent attachment of the pull tab body 1*h* to a slider body 17 (see FIG. 2). Alternatively, a connecting member having at its one end a pintle (neither shown) pivotally receivable in the hollow portion 2*c* can be used.

Figure 12:
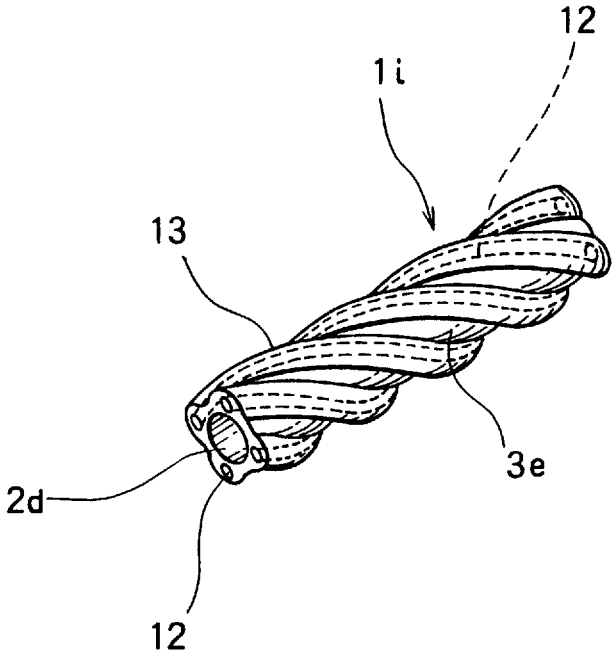
FIG. 12 is a perspective view showing a ninth modified form of the pull tab body according to the tenth embodiment of the present invention.

FIG. 12 shows a pull tab body 1*i* according to a tenth embodiment of the present invention. The pull tab body 1*i* is formed on a rotational extrusion molding means or machine of the vertical type and has no means or part corresponding to the connecting portion or the grip piece as described above. The pull tab body 1*i* comprises an elongated bar having on its outside surface a plurality of parallel ridges 13 extending helically about a longitudinal axis of the pull tab body 1*i* along the length of the pull tab body 1*i*. The helical ridges 13 form a helically toothed surface (uneven surface) 3*e*. A cord-like ornamental material 12 is embedded in each of the helical ridges 13, and for ornamental purposes, the pull tab body 1*i* is preferably transparent or semitransparent. The pull tab body 1*i* further has an internal hollow portion 2*d* in the form of a central circular hole along a core of the pull tab body 1*i*. By virtue of the hollow portion 2*d*, the pull tab body 1*i* has an adequate degree of flexibility or elasticity. Since the pull tab body 1*i* has no connecting portion, as described above, a connecting member such as shown in FIG. 10 may be used to complete a pull tab.

FIG. 13 schematically illustrates the manner in which a pull tab body of this invention is molded on an extrusion molding machine. The illustrated extrusion molding machine is of the horizontal type in which the orifice of an extruding die 20 has a shape complementary in contour to the shape of a longitudinal cross section of a desired product (pull tab body) horizontally arranged. A thermoplastic synthetic resin is forced or extruded through the orifice of the extruding die 20 to be a continuous formed blank 21 of the desired pull tab body. The blank 21 is subsequently cut into pull tab bodies of the individual product widths.

In the case of extrusion molding of the vertical type, the orifice of an extruding die (not shown) has a shape complementary in contour to the shape of a transverse cross section of the desired product (pull tab body). A continuously formed blank after having been extruded through the orifice, which is in a form of a long bar, is cut into pull tab bodies of individual product length.

The slider pull tabs of the foregoing construction have various advantages, as described below.

Since the slider pull tab has a pull tab body 1, 1*a*–1*i* of extruded thermoplastic synthetic resin having an internal hollow portion 2, 2*a*–2*d* extending longitudinally or transversely therethrough, and an uneven outside surface 3, 3*a*–3*d*, it is possible to easily provide the pull tab body with a desired degree of flexibility or elasticity as well as attractive appearance. Further, the extrusion-molded pull tab body can be mass-produced with a considerable reduction in manufacturing cost. The pull tab having such a pull tab body 1, 1*a*–1*i* is good in appearance and can be produced at a low cost.

The pull tab body 1, 1*a*–1*i* may be transparent or semitransparent, in which instance it is preferable to provide an ornamental material 12 embedded in the transparent or semitransparent pull tab body 1, 1*a*–1*i*. Thus, a pull tab having an ornamental function can be easily produced.

In the case where the hollow portion 2*d* extends longitudinally through in the pull tab body 1*i* and along a core of the pull tab body 1*i*, the uneven outside surface 3*e* preferably has at least one ridge 13 extending helically about a longitudinal axis of the hollow portion 2*d*. The helical ridge 13 provides a particular design pattern and can improve the aesthetical appearance of the pull tab body 1*i* and the pull tab as a whole.

Since pull tab body 1, 1*a*–1*i* has an integral grip piece 6 at its one end, the pull tab body 1, 1*a*–1*i* can be gripped with utmost ease and reliability, thus insuring a smooth and reliable sliding operation of the slider.

Furthermore, by virtue of a connecting portion 4, 4*a*–4*c* formed integrally with an end of the pull tab body, the pull tab body 1, 1*a*–1*e* can be easily connected to a slider body 17 to complete a slide fastener slider.

The connecting portion 4*c* of the pull tab body 1*e* may form a planar connecting ring 8*a* adapted to be connected to the slider body 17. In this case, the pull tab body 1*e* can be directly attached to the slider body 17 without the intervention of a connecting member, thereby facilitating the slider assembling operation.

Alternatively, the pull tab may further include a connecting member 7, 7*a*–7*c* having a connecting ring 8, 8*b* adapted to be connected to the slider body 17. In this case, the connecting member 7, 7*a*–7*c* is first connected to the connecting portion 4, 4*a*, 4*b* of the pull tab body 1, 1*a*–1*d*, 1*f*–1*i* to complete a pull tab, and subsequently attached to the slider body 17 to complete a slider.

As a further alternative, the pull tab may further includes the connecting member 7, 7*a*–7*c* having a connecting ring 8, 8*b* adapted to be connected to a slider body 17. The connecting member 7, 7*a*–7*c* is directly connected to an end of the pull tab body 1, 1*a*–1*d*, 1*f*–1*i*, and then attached to the slider body 17 via the connecting ring 8, 8*b*. The pull tab thus constructed is simpler in construction than one having a connecting portion.

Obviously, various minor changes and modifications of the present invention are possible in the light of the above teaching. It is therefore to be understood that within the scope of the appended claims the invention may be practiced otherwise than as specifically described.

What is claimed is:

1. A pull tab of a slide fastener slider, comprising:

a pull tab body molded of thermoplastic synthetic resin having an internal hollow portion extending longitudinally therethrough along said pull tab body, said pull tab body having a flexibility by virtue of said hollow portion and an uneven outer surface formed by at least one ridge extending longitudinally on said surface.

2. A pull tab according to claim 1, wherein said pull tab body is extrusion-molded.

3. A pull tab according to claim 1, further including a connecting member having a connecting ring adapted to be connected to a slider body, said connecting member having connected to an end of said pull tab body.

4. A pull tab according to claim 1, wherein said ridge is linear.

5. A pull tab according to claim 1, wherein said ridge extends helically about a longitudinal axis of said hollow portion.

6. A pull tab of a slide fastener slider, comprising:

a pull tab body molded of thermoplastic synthetic resin having an internal hollow portion extending therethrough, wherein said hollow portion extends longitudinally through said pull tab body, and has an uneven outside surface with at least one ridge extending helically about a longitudinal axis of said hollow portion along the length of said pull tab body.

7. A pull tab of a slide fastener slider, comprising:

a pull tab body molded of thermoplastic synthetic resin having a front surface and a back surface and at least one internal hollow portion transversely therethrough between said front and back surfaces;

said pull tab body having a flexibility by virtue of said hollow portion;

each of said front and back surfaces of said pull tab body having a smooth arc-like surface curving outwardly; and said hollow portion having a profile curving parallel to said arc-like surface of said pull tab body.

8. A pull tab according to claim 7, wherein said pull tab body is extrusion-molded.

9. A pull tab according to claim 7, wherein said pull tab body is one of a transparent and a semi-transparent material and includes an ornamental material embedded therein.

10. A pull tab according to claim 7, wherein said pull tab body has a grip piece formed integrally with an end of said pull tab body.

11. A pull tab according to claim 7, wherein said pull tab body has a connecting portion formed integrally with an end of said pull tab body for connecting said pull tab body to a slider body.

12. A pull tab body according to claim 11, wherein said connecting portion of said pull tab body forms a planar connecting ring adapted to be connected to the slider body.

13. A pull tab according to claim 11, further including a connecting member having a connecting ring adapted to be connected to said slider body, said connecting member being connected to said connecting portion of said pull tab body at an end remote from said connecting ring.

14. A pull tab of a slide fastener slider, comprising:

a pull tab body molded of thermoplastic synthetic resin having a front surface and back surface and at least one internal hollow portion transversely therethrough between said front and back surfaces;

said pull tab body having a flexibility by virtue of said hollow portion;

each of said front and back surfaces of said pull tab body having a corrugated surface; and said hollow portion having a profile corrugated parallel to said corrugated surface of said pull tab body.

15. A pull tab according to claim 14, wherein said pull tab body is extrusion-molded.

16. A pull tab according to claim 14, wherein said pull tab body is one of a transparent and a semi-transparent material and includes an ornamental material embedded therein.

17. A pull tab according to claim 14 wherein said pull tab body has a grip piece formed integrally with an end of said pull tab body.

18. A pull tab according to claim 14, wherein said pull tab body has a connecting portion formed integrally with an end of said pull tab body for connecting said pull tab body to a slider body.

19. A pull tab according to claim 18, wherein said connecting portion of said pull tab body forms a planar connecting ring adapted to be connected to the slider body.

20. A pull tab according to claim 18 further including a connecting member having a connecting ring adapted to be connected to said slider body, said connecting member being connected to said connecting portion of said pull tab body at an end remote from said connecting ring.

* * * * *